United States Patent [19]

Gunderson et al.

[11] Patent Number: 5,020,634

[45] Date of Patent: Jun. 4, 1991

[54] SUPPORT BRACKET

[75] Inventors: Robert A. Gunderson, St. Alberta; Leonard E. Koffski, Duncan; Gary W. Gunderson, Lake Cowichan, all of Canada

[73] Assignee: First Choice Distributors, Inc., Canada

[21] Appl. No.: 485,447

[22] Filed: Feb. 27, 1990

[51] Int. Cl.[5] ..... B27B 21/00; B25H 1/06

[52] U.S. Cl. ..... 182/184; 182/185; 182/225

[58] Field of Search ..... 182/181–186, 182/224–226

[56] References Cited

U.S. PATENT DOCUMENTS 4,308,934 1/1982 Jackson ..... 182/185
4,502,565 3/1985 Koffski ..... 182/184

FOREIGN PATENT DOCUMENTS 1119217 2/1982 Canada .
220351 5/1987 European Pat. Off. .

*Primary Examiner*—Reinaldo P. Machado
*Attorney, Agent, or Firm*—Barrigar & Oyen

[57] ABSTRACT

A work support bracket is improved by providing it with brace members having a Z cross sectional shape. The brace members are fixed to first and second horizontal socket members respectively such that the upper horizontal segments of the brace members extend away from one another. The lower, central regions of the vertical segments of the brace members are notched to straddle the first and second horizontal socket members respectively. The outward, central regions of the upper horizontal segments are notched to define elongated pathways extending through first and second generally vertical socket members respectively and through said notched outward central regions respectively. The lower horizontal segments of the brace members are first and second pairs of tab members which extend from opposed ends of the first and second brace members respectively. The first pair of tab members is coplanar with the upper surface of the first horizontal socket; and, the second pair of tab member assumes a position coplanar with the first horizontal socket, when the first and second horizontal sockets are interconnected. The lower horizontal segment of the second brace member has a third tab member which extends atop the second horizontal socket member, coplanar with the first horizontal socket, when the first and second horizontal socket members are interconnected.

11 Claims, 3 Drawing Sheets

SUPPORT BRACKET

FIELD OF THE INVENTION

This application pertains to an improved support bracket which may be releasably attached to some lumber pieces to form a variety of structures.

BACKGROUND OF THE INVENTION

The prior art is exemplified by Canadian Patent No. 1,119,217 issued March 2, 1982 for an invention of Leonard E. Koffski entitled "Bracket"; by U.S. Pat. No. 4,502,565 issued March 5, 1985 for an invention of James R. Koffski entitled "Work Support"; and, by European Patent Application No. 220,351 published May 6, 1987 in respect of an invention of James R. Koffski entitled "Work Support Bracket".

These prior art references disclose various forms of support brackets, two of which may be releasably attached to pieces of standard dimension lumber to form a variety of four legged structures such as work benches, tables, saw horses, temporary shelters, etc. More particularly, each bracket has a pair of opposed, generally vertical sockets. A piece of lumber is passed through each one of the four vertical sockets found in a pair of brackets, and clamped in place. The horizontal displacement between the tops of the sockets is adjusted and one or more planks are laid atop the opposed pair of brackets. The height of each of the four lumber pieces, which serve as the legs of the structure, may be adjusted to level the working surface provided by the plank(s). Each bracket may be separated into two halves and a further piece of lumber extended between the two halves, coupling them together, so that a pair of similarly extended brackets provide an enlarged working surface.

The prior art devices aforesaid have been found to have a number of shortcomings. For example, it is sometimes difficult to employ the prior art brackets with untreated lumber which has been exposed to moisture, or which has been excessively dried. The dimensions of such lumber are often too great to fit within the sockets of the prior art devices, or too small to fit snugly within the sockets. As another example, if the prior art devices are extended as aforesaid to provide an enlarged working surface, the connection between the brackets and the pieces of extension lumber tends to lack rigidity. As a further example, it is sometimes desirable to allow the four legs of the structure constructed with a pair of brackets to extend considerably above the tops of the brackets, which is inhibited by the construction of the prior art devices.

The present invention provides an improved support bracket which overcomes the shortcomings of the prior art.

SUMMARY OF THE INVENTION

The invention improves upon prior art work support brackets which are characterized by:

(a) first and second opposed, generally vertical sockets for receiving first and second leg members;

(b) first and second releasable clamps for releasably clamping the first and second leg members within the first and second generally vertical sockets respectively;

(c) joined to, and extending generally perpendicular to the first and second generally vertical sockets, first and second interconnectible, horizontal sockets for receiving opposed ends of an extension member; and, (d) first and second upwardly extending brace members projecting transversely atop the first and second horizontal sockets respectively.

In a broad form, the improvement afforded by the invention consists of providing the brace members with a cross sectional shape, the brace members being fixed to the first and second horizontal sockets respectively such that the upper horizontal segments of the brace members extend away from one another.

The lower, central regions of the vertical segments of the brace members are advantageously notched to straddle the first and second horizontal sockets respectively.

The outward, central regions of the horizontal segments are also advantageously notched to define elongated pathways extending through the first and second generally vertical sockets respectively and through the notched outward central regions respectively.

The lower horizontal segments of the brace members preferably comprise first and second pairs of tab members which extend from opposed ends of the first and second brace members respectively.

Advantageously, the first pair of tab members is made coplanar with the upper surface of the first horizontal socket; and, the second pair of tab members assumes a position coplanar with the first horizontal socket, when the first and second horizontal sockets are interconnected.

The lower horizontal segment of the second brace member further may be provided with a third tab member extending atop the second horizontal socket, coplanar with the first horizontal socket when the first and second horizontal sockets are interconnected.

The first and second horizontal sockets may be provided with lower surfaces which taper upwardly toward the respective junctions of the first and second horizontal sockets with the first and second generally vertical sockets.

Advantageously, the first and second horizontal sockets may be telescopically interconnectible. The first and second horizontal sockets may also have vertical side walls which taper inwardly toward one another All of the sockets may have radiused internal corners to improve their ability to receive a wide variety of 2"×4" stock.

To further improve the torsional strength of the overall structure, the brace members have a cross sectional shape.

DETAILED DESCRIPTION OF THE PREFERRED EMBODIMENT

Figure 1:
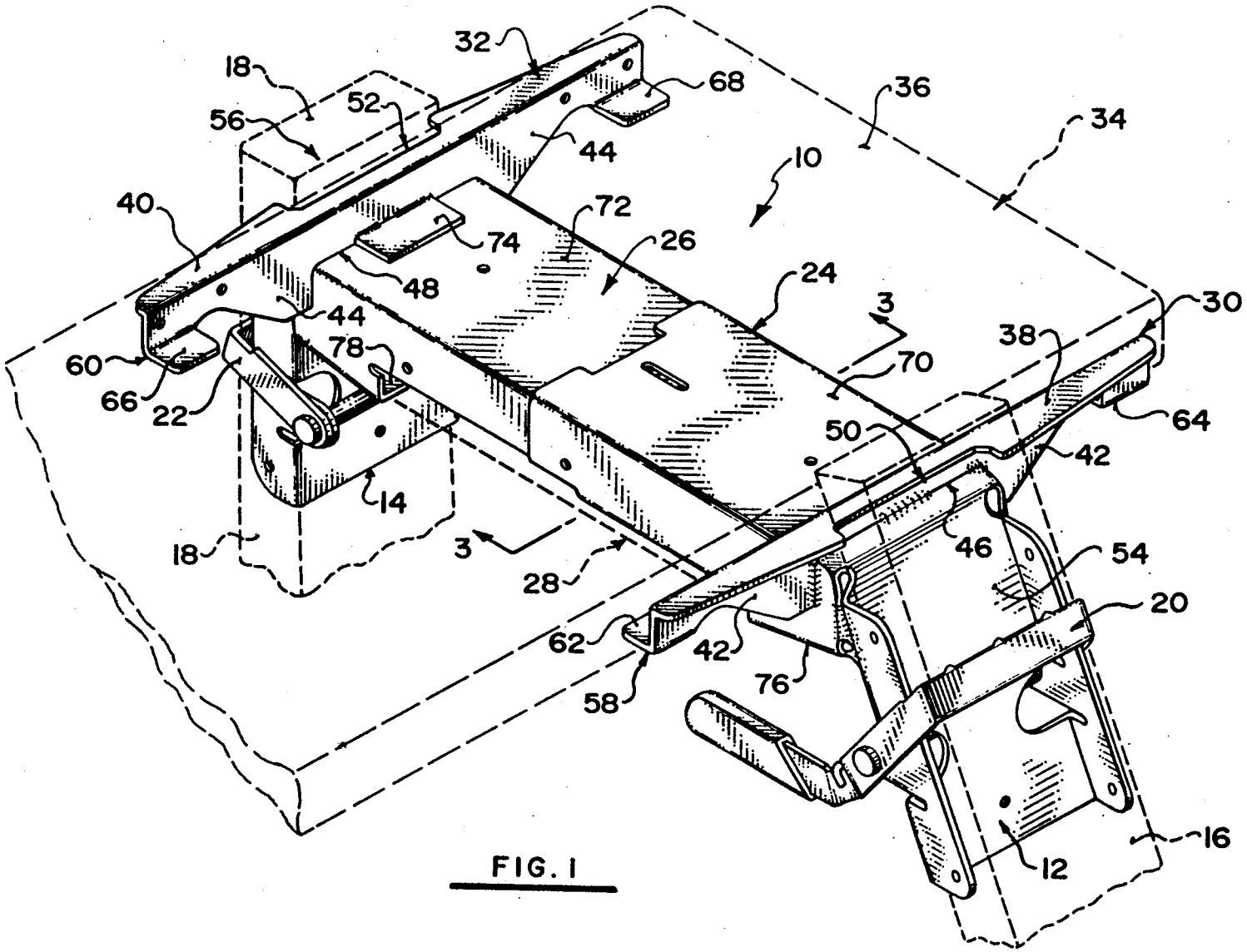
FIG. 1 an oblique pictorial illustration of a single work support bracket constructed in accordance with the preferred embodiment of the invention, shown coupled to first and second leg support members, and supporting a plank.

The drawings illustrate a work support bracket 10 which, like prior art work support brackets, has:

(a) first and second opposed, generally vertical sockets 12, 14 for receiving first and second leg members 16, 18 (which may be cut from readily available 2"×4" lumber);

(b) first and second releasable clamps 20, 22 for releasably clamping first and second leg members 16, 18 within sockets 12, 14 respectively;

(c) joined to, and extending generally perpendicular to sockets 12, 14, first and second telescopically interconnectible, horizontal sockets 24, 26 for optionally receiving opposed ends of an extension member 28 (FIG. 2-also cut from a 2"×4"); and, (d) first and second upwardly extending brace members 30, 32 projecting transversely atop first and second horizontal sockets 24, 26 respectively to brace the sides of one or more planks 34 laid atop horizontal sockets 24, 26 (and atop any extension member placed between sockets 24, 26) to form a working surface 36.

A pair of brackets, each identical to bracket 10, may be used to form a variety of four legged structures such as work benches, tables, saw horses, soil screen frames, temporary shelters, green houses, boat docks, walkways situated over uneven ground etc.

The present invention improves upon prior art brackets of the type aforesaid by constructing brace members 30, 32 with a cross-sectional shape. Brace members incorporated in the prior art brackets have had an L-shaped cross-section. The cross-sectional shape significantly improves the torsional strength of brace members 30, 32 which in turn improves the strength and hence the safety and reliability of structures constructed with bracket 10. Brace members 30, 32 are welded to first and second horizontal sockets 24, 26 respectively, such that the upper horizontal segments 38, 40 of brace members 30, 32 extend away from one another. The vertical segments 42, 44 of brace members 30, 32 provide side support for one or more planks 34 laid side by side atop horizontal sockets 24, 26 (and atop any extension member placed between sockets 24, 26) to form a working surface 36. Welding of brace members 30, 32 to sockets 24, 26 improves the rigidity of the overall structure by ensuring that planks 34 are held firmly in place between the brace members and by resisting twisting forces imposed on the structure during use.

The lower, central regions of vertical segments 42, 44 of brace members 30, 32 are notched, as shown at 46, 48 so that vertical segments 42, 44 straddle first and second horizontal sockets 24, 26 respectively. The opposed sides of notched regions 46, 48 of brace members 30, 32 thus bear against the vertical sides of first and second horizontal sockets 24, 26 respectively. This further improves the strength of bracket 10 and hence the safety and reliability of structures constructed therewith.

The outward facing, central regions of horizontal segments 38, 40 are notched, as shown at 50, 52, to define elongated pathways 54, 56 which extend through first and second generally vertical sockets 12, 14 respectively, and through notched regions 50, 52 respectively. This allows leg members 16, 18 to protrude above brace members 30, 32 to a considerable height, while inhibiting lateral movement of leg members 16, 18. When a load is applied to the overall structure, the relatively sharp edges of notched regions 50, 52 may "bite" into leg members 16, 18 which would further improve the rigidity of the structure.

The lower horizontal segments 58, 60 of brace 30, 32 comprise first and second pairs of tab members 62, 64, 66, 68 which extend inwardly from the opposed ends of first and second brace members 30, 32 respectively. These tabs are better able to accommodate warped or non-flat planks which may be used to form working surface 36 than are the prior art brackets, which employ brace members having a continuous L-shaped cross-section.

Figure 2:
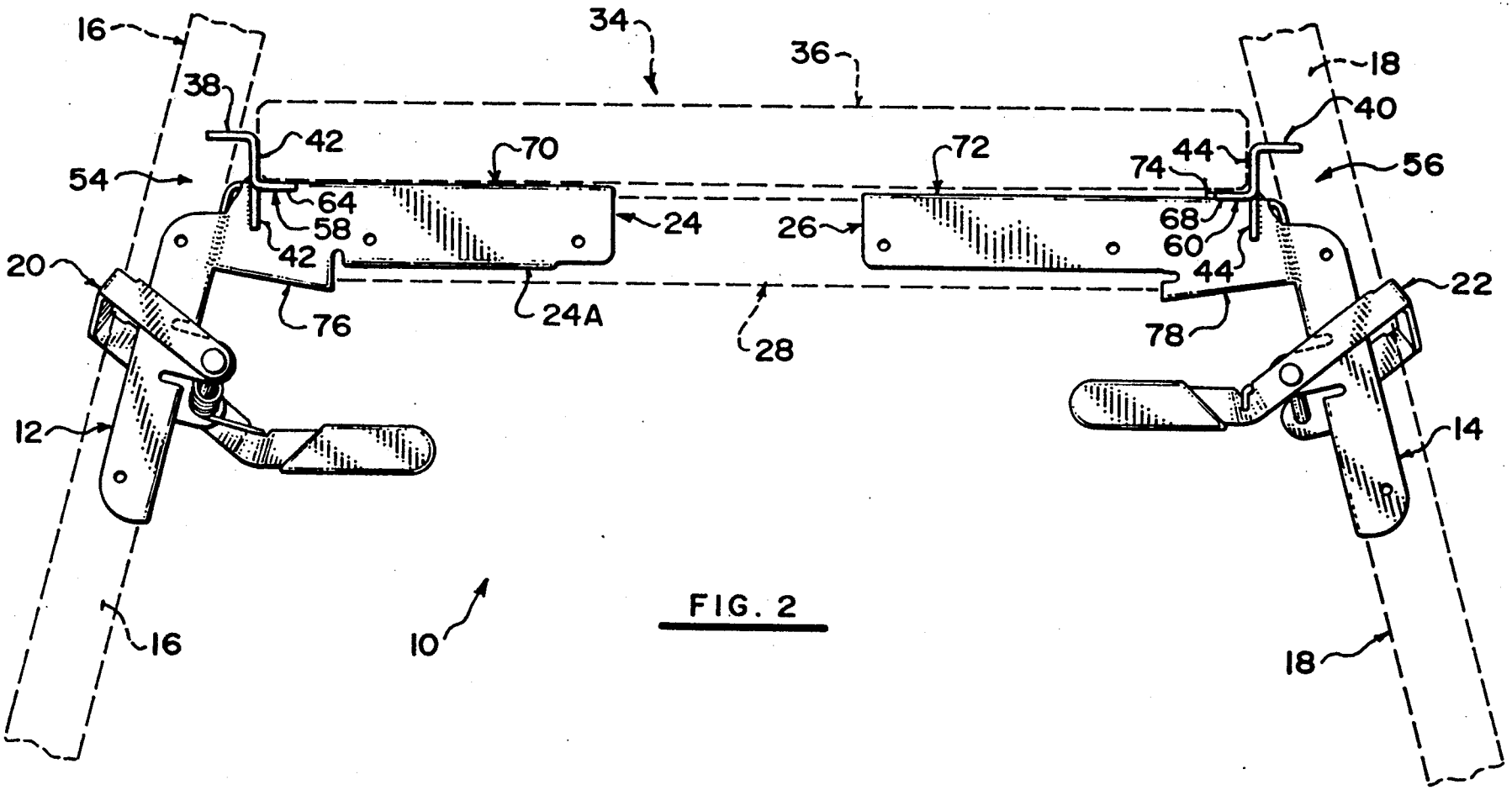
FIG. 2 a rear elevation view of the structure of FIG. 1, shown modified to include a horizontal extension member.

As best seen in FIG. 2, first pair of tab members 62, 64 are coplanar with the upper surface 70 of first horizontal socket 24. Second pair of tab members 66, 68 extend above the upper surface 72 of second horizontal socket 26 by an amount equal to the thickness of the material used to form first horizontal socket 24. This compensates for the difference in height between surfaces 70, 72 when horizontal sockets 24, 26 are interconnected, by ensuring that second pair of tab members 66, 68 also assume a position coplanar with first horizontal socket 24 when first and second horizontal sockets 24, 26 are interconnected. This in turn ensures that planks laid atop horizontal sockets 24, 26 to form working surface 36 do not wobble, as happens in prior art brackets which do not compensate for differences in height between the base segments of brace members atop the telescopically interconnected horizontal sockets.

As best seen in FIG. 1, lower horizontal segment 60 of second brace member 32 is provided with a third tab member 74 which extends atop second horizontal socket 26, coplanar with first horizontal socket 24, when first and second horizontal sockets 24, 26 are interconnected. This assists in compensating for the difference in height between surfaces 70, 72 when horizontal sockets 24, 26 are interconnected, thus contributing to stabilization of work surface 36.

As best seen in FIG. 2, first and second horizontal sockets 24, 26 have lower flanges 76, 78 respectively, which taper upwardly towards the respective junctions of first and second horizontal sockets 24, 26 with first and second generally vertical sockets 12, 14. Tapered sockets 24, 26 are better able to frictionally retain the ends of extension member 28 than are the corresponding non-tapered sockets of the prior art brackets.

Figure 3:
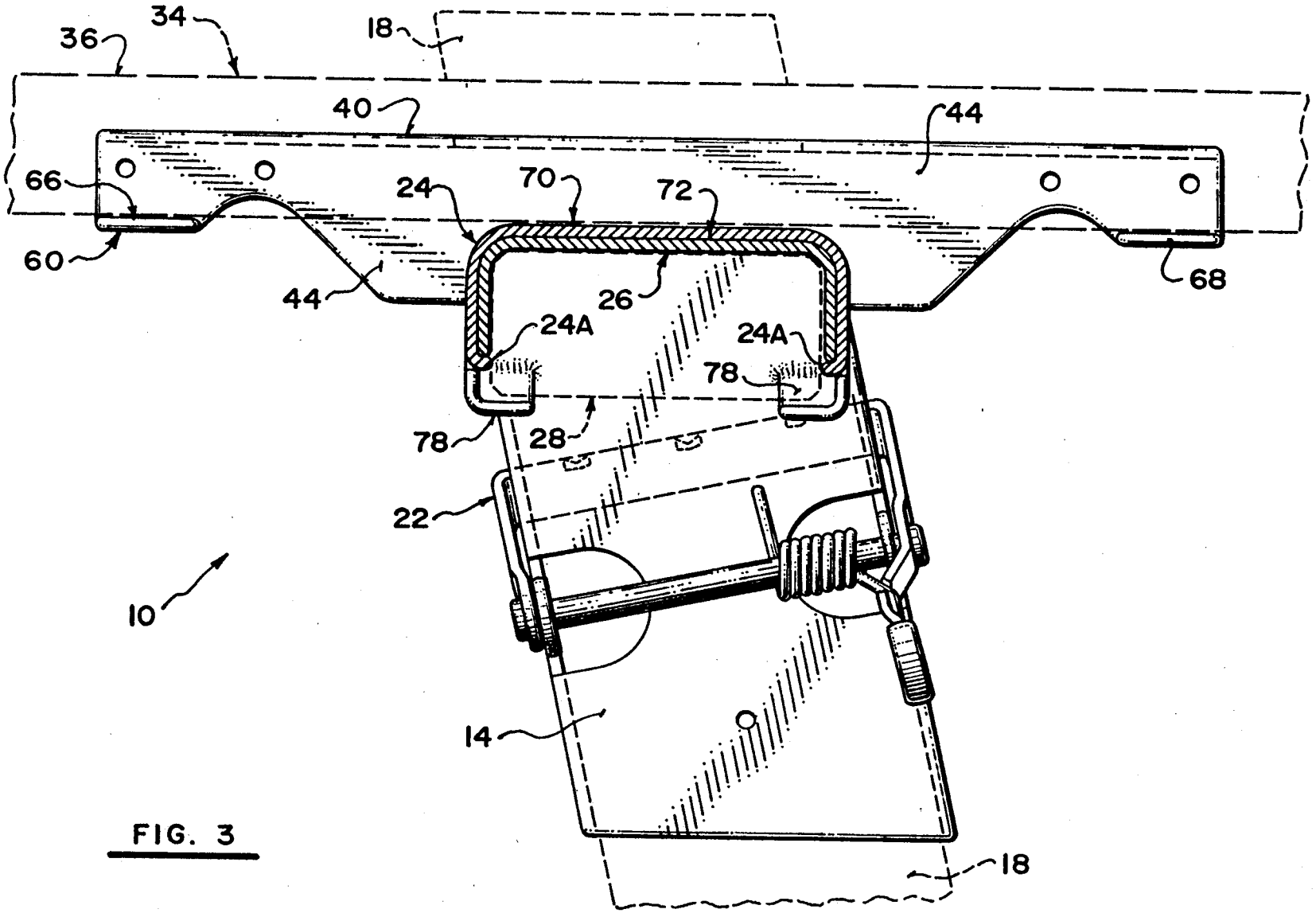
FIG. 3 a cross-sectional view taken with respect to line 3—3 of FIG. 1.

As best seen in FIG. 3, inwardly turned edges 24A are provided on the lower ends of the sides of first horizontal socket 24. If no extension member 28 is present (i.e. if first and second horizontal sockets 24, 26 are telescopically interconnected) edges 24A project beneath and support the sides of second horizontal socket 26 to resist vertical movement of first and second horizontal sockets 24, 26 relative to one another, thereby improving the stability of the structure. If extension member 28 is connected between first and second horizontal sockets 24, 26 edges 24A "bite" into and support the sides of extension member 28 to resist vertical movement of extension member 28 relative to first and second horizontal sockets 24, 26, further improving the stability of the structure.

As best seen in FIG. 3, the internal corners of sockets 12, 14, 24, 26 are radiused. This simplifies insertion of the respective leg and extension members into the sockets and ensures that any variety of rough dimension, dressed, undressed, wet or dry 2"×4" lumber may be used as the leg and extension members.

As will be apparent to those skilled in the art in the light of the foregoing disclosure, many alterations and modifications are possible in the practice of this invention without departing from the spirit or scope thereof. For example, first and second horizontal sockets 24, 26 need not be telescopically interconnectible with one another, but may be shortened such that an extension member 28 must always be positioned between the two sockets. Also, the upper horizontal segments 38, 40 of brace members 30, 32 may be shortened and the lower horizontal segments 58, 60 extended to give brace members 30, 32 a cross sectional shape having further improved torsional strength. As yet another example, the vertical side walls of first and second horizontal sockets 24, 26 may be inwardly tapered to further improve frictional retention of the ends of extension member 28 within the sockets. Apertures may also be provided in the faces and sides of each of sockets 12, 14, 24, 26 through which screws may be driven into the respective leg and extension members in order to improve the rigidity of the overall structure. Vertical segments 42, 44 of brace members 30, 32 could also be constructed to extend further downwardly along the sides of first and second horizontal sockets 24, 26 (to which vertical segments 42, 44 are welded); or, vertical segments 42, 44 could be wrapped and welded completely around the ends of first and second horizontal sockets 24, 26 to further resist twisting forces imposed on the structure during use. Accordingly, the scope of the invention is to be construed in accordance with the substance defined by the following claims.

We claim:

1. In a work support bracket comprising:

(a) first and second opposed, generally vertical sockets for receiving first and second leg members;

(b) first and second releasable clamps for releasably clamping said first and second leg members within said first and second generally vertical sockets respectively;

(c) joined to, and extending generally perpendicular to said first and second generally vertical sockets, first and second interconnectible, horizontal sockets for receiving opposed ends of an extension member; and, first and second upwardly extending brace members projecting transversely atop said first and second horizontal sockets respectively; the improvement wherein:

(i) said brace members have a cross sectional shape;

(ii) said brace members are fixed to said first and second horizontal sockets respectively such that the upper horizontal segments of said brace members extend away from one another; and, (iii) the lower, central region of the vertical segments of said brace members are notched to straddle said first and second horizontal sockets respectively.

2. In a work support bracket as defined in claim 1, the further improvement wherein the outward, central regions of said horizontal segments are notched to define elongated pathways extending through said first and second generally vertical sockets respectively and through said notched outward central regions respectively.

3. In a work support bracket as defined in claim 2, the further improvement wherein the lower horizontal segments of said brace members comprise first and second pairs of tab members extending from opposed ends of said first and second brace members respectively.

4. In a work support bracket as defined in claim 3, the further improvement wherein said first pair of tab members are coplanar with the upper surface of said first horizontal socket; and, said second pair of tab members are coplanar with said first horizontal socket, when said first and second horizontal sockets are interconnected.

5. In a work support bracket as defined in claim 4, the further improvement wherein said lower horizontal segment of said second brace member further comprises a third tab member extending atop said second horizontal socket coplanar with said first horizontal socket when said first and second horizontal sockets are interconnected.

6. In a work support bracket as defined in claim 5, the further improvement wherein said first and second horizontal sockets have lower surfaces which taper upwardly towards the respective junctions of said first and second horizontal sockets with said first and second generally vertical sockets.

7. In a work support bracket as defined in claim 6, the further improvement wherein said first and second horizontal sockets are telescopically interconnectible.

8. In a work support bracket as defined in claim 6, the further improvement wherein said brace members have a cross sectional shape.

9. In a work support bracket as defined in claim 6, the further improvement wherein said first and second horizontal sockets have vertical side walls which taper inwardly toward one another.

10. In a work support bracket as defined in claim 6, the further improvement wherein said sockets have radiused internal corners.

11. In a work support bracket as defined in claim 6, the further improvement wherein said first horizontal socket has inwardly turned edges for supporting said second horizontal socket when said first and second horizontal sockets are interconnected, and for supporting said extension member when said extension member is positioned between said first and second horizontal sockets.

* * * * *

UNITED STATES PATENT AND TRADEMARK OFFICE

CERTIFICATE OF CORRECTION

PATENT NO. : 5,020,634

DATED : June 4, 1991

INVENTOR(S) : Robert A. Gunderson et al

It is certified that error appears in the above-identified patent and that said Letters Patent is hereby corrected as shown below:

Column 2, line 8, change "a cross sectional shape," to --a ⌊ cross-sectional shape,--.

Column 2, line 50, change "the brace members have a cross" to --the brace members have a ⌊_ cross--.

Column 3, line 27, change "30, 32 with a cross-sectional shape." to --30, 32 with a ⌊ cross-sectional shape.--.

Column 3, line 29, change "The cross-sectional shape" to --The ⌊ cross-sectional shape--.

Column 3, line 67, change "brace 30," to --brace members 30,--.

Column 5, line 6, change "a cross sectional shape" to --a ⌊_ cross sectional shape--.

Column 5, line 44, change "have a cross sectional" to --have a ⌊ cross sectional--.

Column 6, line 37, change "a cross sectional" to --a ⌊_ cross sectional--.

Signed and Sealed this

Thirteenth Day of April, 1993

*Attest:*

STEPHEN G. KUNIN

*Attesting Officer*

*Acting Commissioner of Patents and Trademarks*